United States Patent [19]

Kane

[11] Patent Number: 4,976,055

[45] Date of Patent: Dec. 11, 1990

[54] WALL MOUNTED FRAME FOR POSTERS AND OTHER PRINTED MATERIAL

[75] Inventor: Michael Kane, River Forest, Ill.

[73] Assignee: Kane Graphical Corporation, Chicago, Ill.

[21] Appl. No.: 125,944

[22] Filed: Nov. 27, 1987

[51] Int. Cl.[5] ..... A47G 1/06; G09F 1/12

[52] U.S. Cl. ..... 40/152.1; 40/152; 40/156; 40/600; 248/206.5; 248/467

[58] Field of Search ..... 40/152, 152.1, 10 R, 40/642, 152, 152.1, 606, 607, 156, 611, 600, 621; 248/473, 206.5, 467

[56] References Cited

U.S. PATENT DOCUMENTS

| | | | |
|---|---|---|---|
| 1,194,064 | 8/1916 | Probert | 40/642 |
| 1,581,981 | 4/1926 | Phelps | 40/642 |
| 1,723,472 | 8/1929 | Elsey | 40/642 |
| 2,785,490 | 3/1957 | Fabry | 40/152 |
| 3,284,940 | 11/1966 | Putman | 40/152.1 |
| 3,298,124 | 1/1967 | Jahn | 40/156 |
| 3,456,374 | 7/1966 | Baermann | 40/156 |
| 4,333,253 | 6/1982 | Cooper | 40/642 |
| 4,779,366 | 10/1988 | Jost | 40/152 |

*Primary Examiner*—Kenneth J. Dorner
*Assistant Examiner*—J. Hakomaki
*Attorney, Agent, or Firm*—Russell E. Hattis

[57] ABSTRACT

A wall mountable frame comprises a rectangular pan-shaped frame including a main rectangular vertical rear wall having forwardly extending magnet-attracting marginal walls defining with said main wall a rectangular sign or poster receiving recess. Screw head-receiving holes are provided in said main vertical wall for receiving the heads of wall mounting anchoring screws which will be fully recessed in said holes, the defining walls of said holes being formed by rearwardly projection portions of said main vertical wall. Magnet bars are insertable along the inner margins of the marginal walls of the frame to hold the margins of sheet material upon said rear wall. Spacers are preferably in the form of double adhesive coated synthetic plastic foam strips are positioned behind said frame to extend along the margins of the rear wall of the frame. The strips space the hole-forming projecting portions of the rear wall from the mounting wall surface of the frame. The strips have a peelable outer layer to cover the outer adhesive layer thereof. The strips are compressed by the tightening of the screws when screws are the frame anchoring means, and can be used as the sole anchoring means of the frame when the peelable outer layer is removed therefrom.

10 Claims, 3 Drawing Sheets

Fig. 2
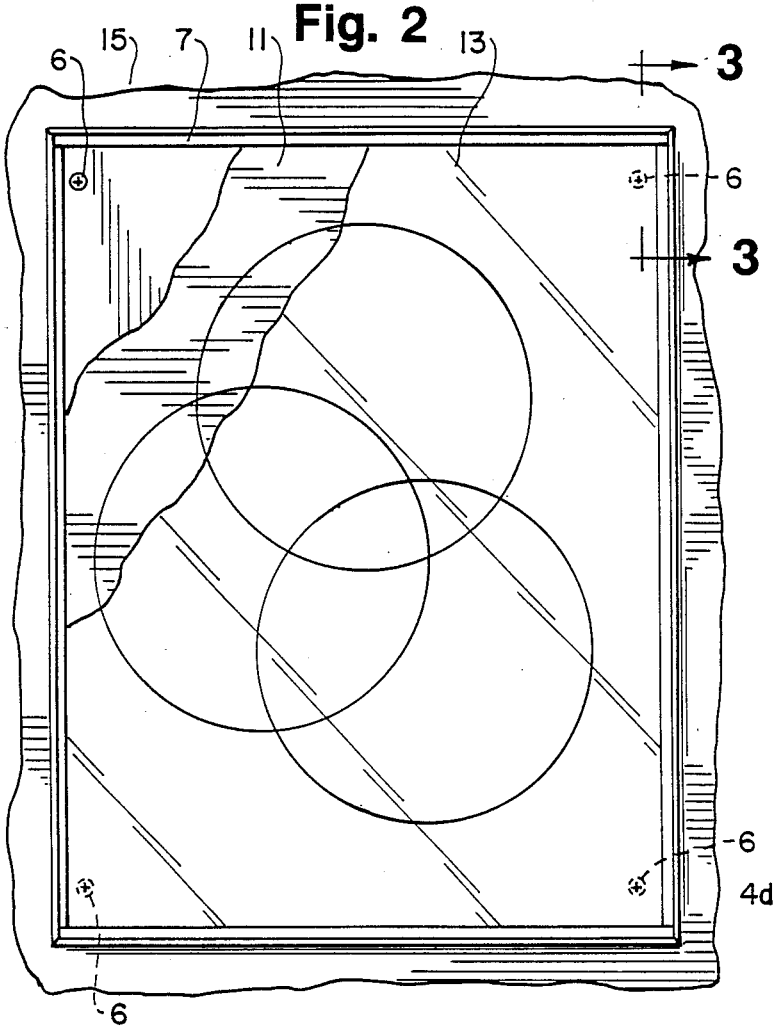
Fig. 3
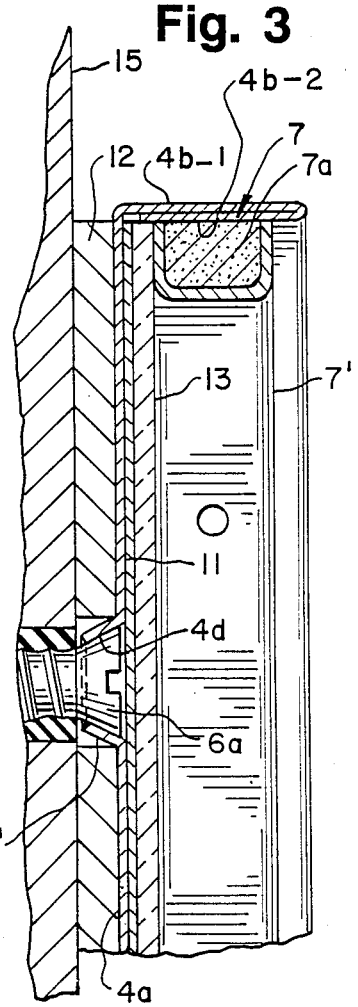
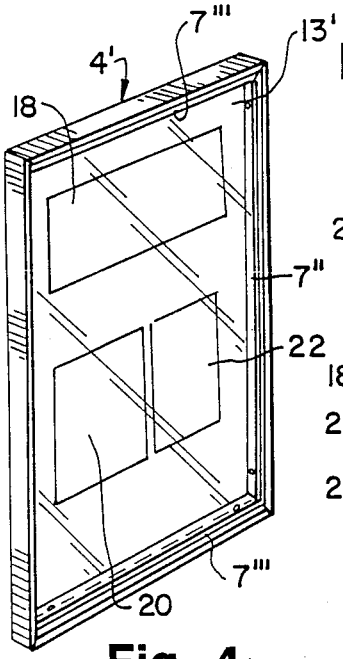
Fig. 4
Fig. 5
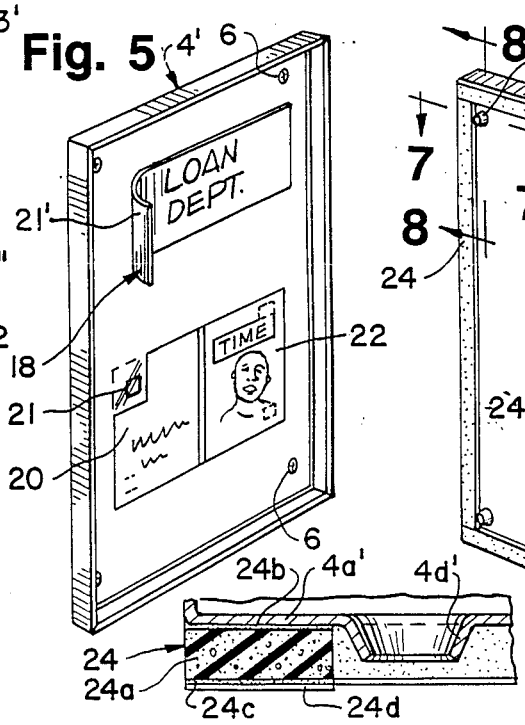
Fig. 6
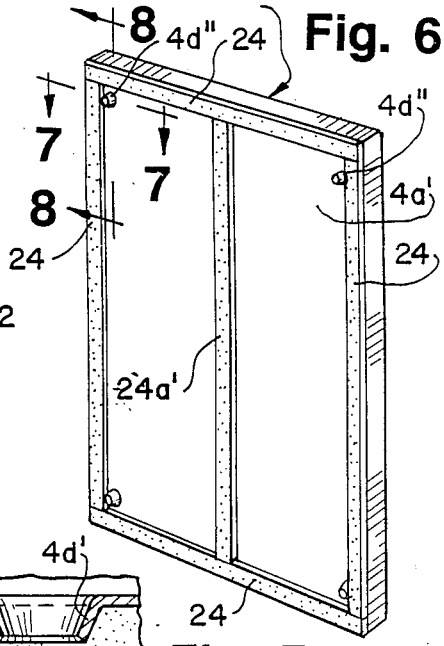
Fig. 7

Fig. 8
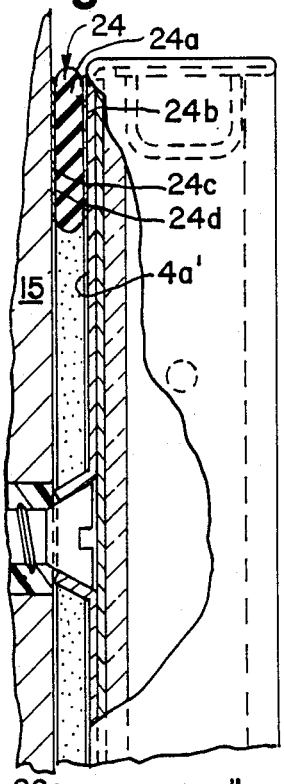
Fig. 9
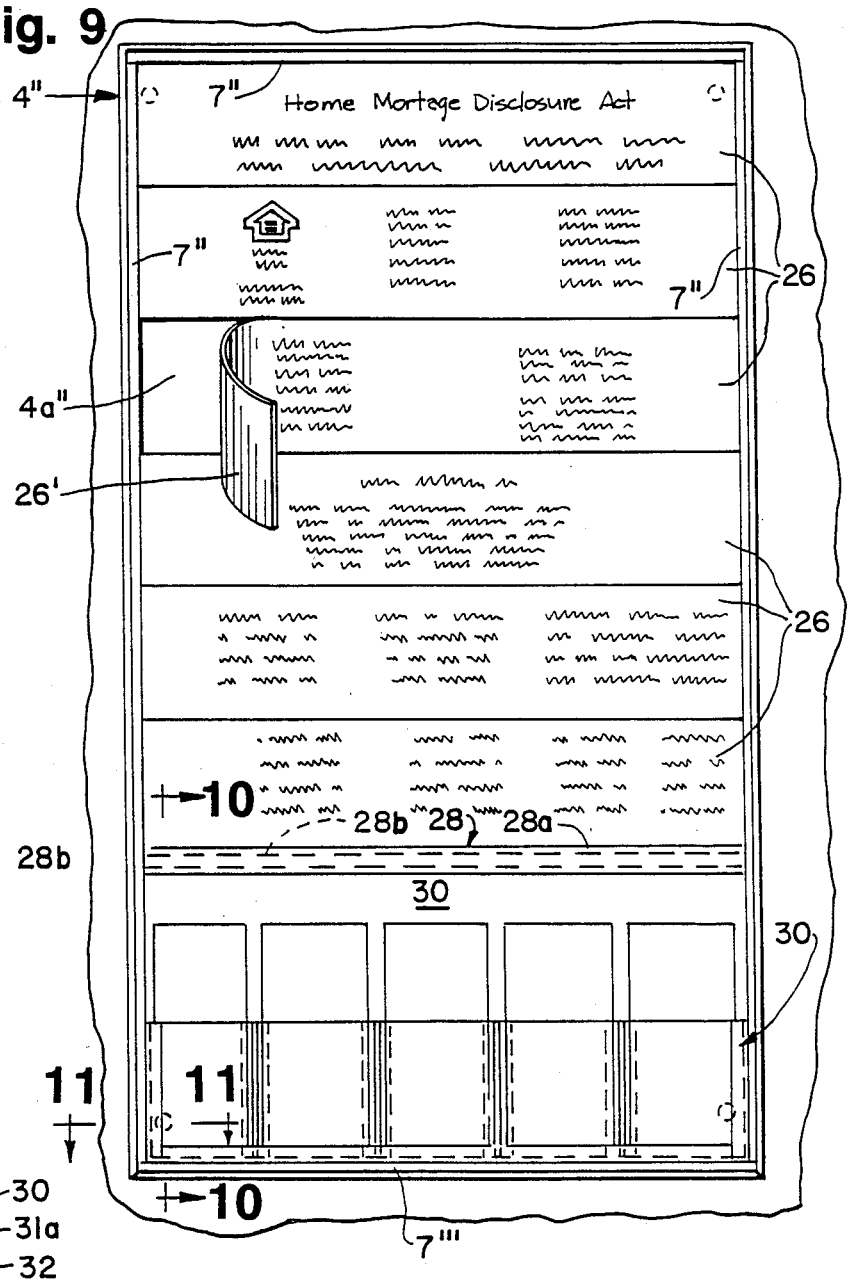
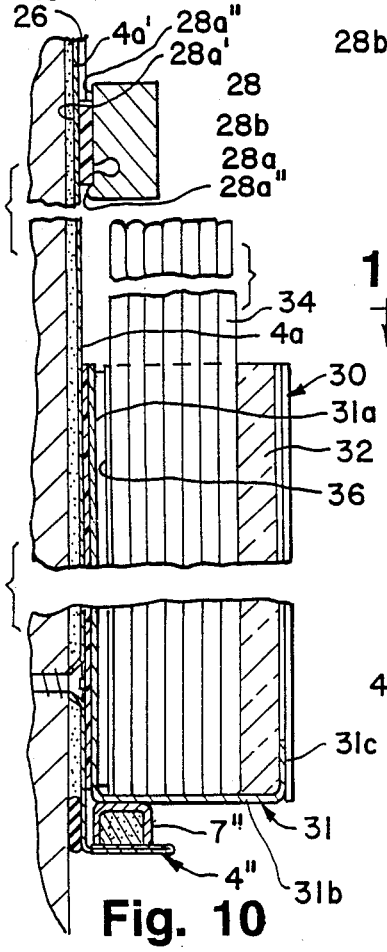
Fig. 10
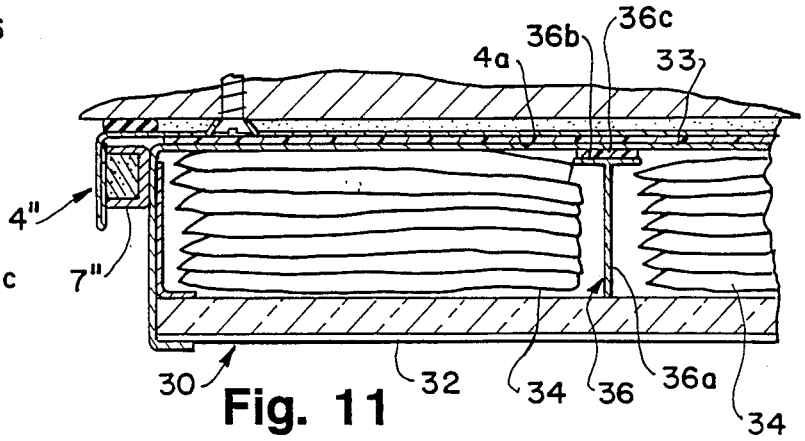
Fig. 11

WALL MOUNTED FRAME FOR POSTERS AND OTHER PRINTED MATERIAL

FIELD OF THE INVENTION

This invention relates to the mounting of signs, posters and other printed material on vertical wall surfaces, and more particularly, to a wall mountable frame assembly for mounting signs, posters, and other printed sheet material on a variety of different kinds of vertical wall surfaces.

BACKGROUND OF THE INVENTION

Various types of frame constructions have been provided for holding posters, signs, etc. upon flat vertical wall surfaces. These frames were secured to vertical wall surfaces by screws or bolts or by double-sided adhesive tape applied to the rear surfaces of the frames. The screws or bolts passed through the corners of the main vertical wall of the frames. Some of these frames had poster pass-through slots in the top or a side margin thereof into which the poster or sign was passed before the frame was mounted. Once the frame was mounted on the wall, it was sometimes not possible to remove the poster or sign from the frames without the frame being removed from the wall because of lack of clearances to do so. In some cases, the frames were designed to permit insertion and removal of a poster or sign through the opening in the front of the frame. Since the opening had to be made slightly larger than the size of the poster or sign which was to fit into it and it is usually desirable that the margins of the frame cover the margins of the poster or sign, such frames sometimes were designed to have pivoted sections which in their opened position fully opened the front of the frame to receive the poster or sign. The pivoted sections were then returned to their closed positions to cover the margins of the poster or sign. This design was obviously a very costly and cumbersome one.

In frames where anchoring screws were used to anchor the rear wall of the frame, the screw heads often projected from the wall. Since the poster or sign could not be placed over these screws, a poster-carrying backboard insert was sometimes used to carry the sheet material forming the poster or sign and the insert and sheet material carried thereby was then placed into the frame. If one wanted the sign or poster to be magnetically held on the backboard by magnet-carrying areas on the back thereof, the backboard would have to be a magnet attracting metal plate, which added to the weight of the frame.

SUMMARY OF THE INVENTION

The present invention provides a unique, inexpensive, improved wall mounted frame for posters and other flexible sheet materials of any size no larger than the rectangular opening in the front of the frame, where the poster can be quickly and easily inserted into the front opening of the frame without the need for hinged frame sections.

In accordance with one aspect of the invention, the frame is a rectangular pan-shaped frame having a magnet-attracting main rear vertical wall and magnet-attracting peripheral side walls. Magnet mounting bars are provided which fit into and along the margins of the frame opening where they are retained in place by contact with the magnet-attracting peripheral walls of the pan-shaped frame. The magnet mounting bars cover and hold in place the margins of any poster, sign or glare-reducing panel of about the size of the frame opening. The magnet mounting bars are preferably provided with a coloration which blends in with the peripheral side walls of the pan-shaped frame, so that the thickness of the frame margins appears to include the width or thickness of the magnet mounting bars and the peripheral side walls of the pan-shaped frame. (While prior to the concept of the present invention, I have commercially used magnetic mounting bars to hold in place glare-eliminating panels in bank sign pedestal supported sign frames, these bars have not been used to hold in place posters or signs in a wall mounted frame as just described.) If smaller printed sheet materials are to be displayed, spots of magnetic tape are applied to the rear thereof, so that this printed material will adhere to the main vertical wall of the frame.

In accordance with another aspect of the invention, the main rear vertical wall of the frame is provided with unique screw head-receiving chamfered holes, struck from the thin rear vertical wall of the frame when it is made of sheet metal. The defining walls of these holes project rearwardly from the main vertical wall of the frame.

In accordance with another aspect of the invention, unique spacing means to be described fill the spaces between at least the margins of the rear wall of the frame and the frame mounting wall surface, to space these rearwardly projecting hole-defining walls from the mounting wall surface and fill unsightly gaps along the edges of the frame.

In a less preferred, first conceived form of the invention, this spacing means was a rectangular spacer board of the same size as the outer dimensions of the frame and made of a non-metallic, light-in-weight material, like masonite. The spacer board had holes which fully receive the chamfered-hole forming projections. Anchoring screws passing through the chamfered holes in the corners of the main vertical rear wall of the frame anchored the frame and the spacer board to all varieties of vertical wall surfaces, without any gaps appearing between the frame and the mounting wall surface involved.

In the later developed and improved form of my wall mounted frame, the spacer means are double-backed adhesive cushion-forming strips placed along the margins of the rear wall of the frame. These strips are much thicker than the extent to which the chamfered hole-forming projections extend beyond the rear surface of the frame. The outer adhesive layer of these strips are covered by a removable paper layer which is removed to expose the adhesive layer if the strips are to anchor the frame to a mounting wall surface. When screws are passed through the chamfered holes of the rear wall of the frame to anchor the frame to a wall, the cushion-forming strips are compressed slightly to aid in anchoring the screws. In all cases, these strips cover or fill the space between the margins of the frame and the mounting wall. The manufacturer and user need not bother with spacer boards, and the user has a choice of using either adhesive strips or screws to mount this all-purpose frame.

The above and other features of the invention will become apparent upon making reference to the specification to follow, the claims and the drawings.

DESCRIPTION OF THE DRAWINGS

FIG. 2 is a front view of the wall mounted poster or sign system of FIG. 1 mounted on a wall;

FIG. 3 is a fragmentary vertical sectional view through the wall mounted poster or sign system of FIG. 2, taken along section line 3—3;

FIG. 4 is a perspective front view of a modified wall mounted frame which does not use the spacer board shown in FIGS. 1–3 and where individual smaller magnetically held sheets of printed matter are mounted in a frame similar to the frame of FIGS. 1–3 except that double layered cushion-forming strips are applied the rear of the frame;

FIG. 5 is a perspective view of the frame of FIG. 4, with the glare-reducing panel and magnet holding bars shown in FIG. 4 removed therefrom to fully expose the magnetically held sheets of printed material on the main vertical wall of the mounting frame thereshown;

FIG. 6 is a perspective rear view of the frame of FIG. 4, showing the cushion-forming mounting strips;

FIG. 7 is a fragmentary sectional view through FIG. 6, along section lines 7—7 thereof;

FIG. 8 is a sectional view through the mounting frame shown in FIGS. 4 through 7, when the frame is anchored to a vertical wall surface;

FIG. 9 is a front elevational view of a modified frame from that shown in FIGS. 4 through 7, with the frame increased in size to hold a sized poster or bank data information strips as shown and a brochure holder rack;

FIG. 10 is a fragmentary vertical sectional view through FIG. 9 along section line 10—10 thereof;

FIG. 11 is a fragmentary sectional view through FIG. 9, taken along section line 11—11;

DESCRIPTION OF EXEMPLARY FORMS OF THE INVENTION SHOWN IN THE DRAWINGS

Figure 1:
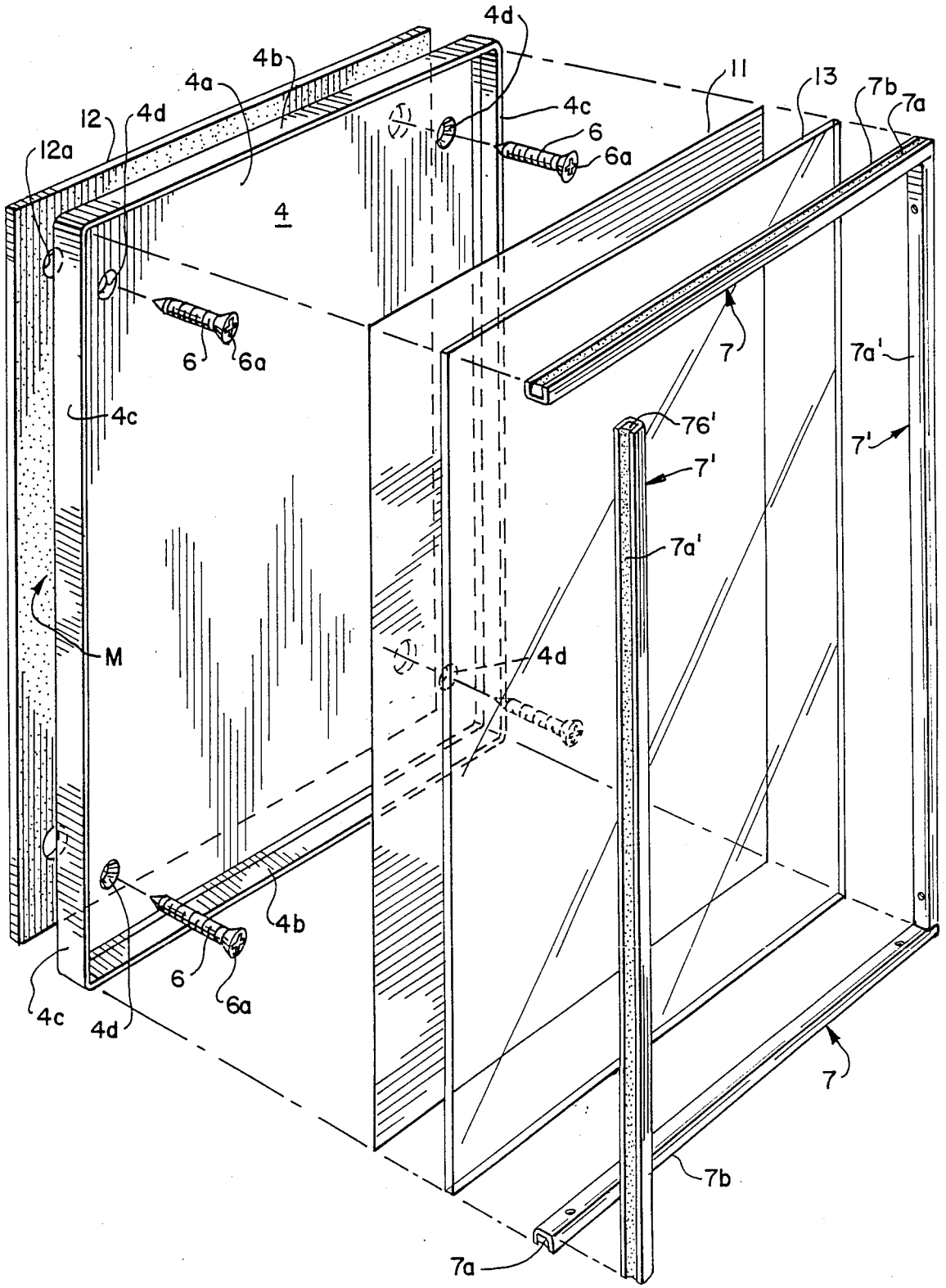
FIG. 1 a perspective, exploded view of the different parts making up the originally conceived wall mounted poster or sign system of the invention, where a full-sized sign or poster is held in place by magnet bars within a pan-shaped frame, in turn, anchored by screws passing through a spacer board to anchor the frame to a vertical wall.

Refer now to FIG. 1, which shows a less preferred form of the invention first conceived for supporting large signs or posters 11, such as 22″×28″ signs or posters. It includes a pan-shaped frame 4 made of steel or other suitable magnet-attracting metal. The frame illustrated was made from a single stamped piece of sheet metal. It has a main rectangular vertical wall 4*a* with margins terminating in forwardly projecting top and bottom marginal walls or flanges 4*b*—4*b* and left and right marginal side walls or flanges 4*c*—4*c*. These marginal walls define a rectangular recess of slightly greater size than the largest poster or sign 11 to be received in the frame. The poster or sign is usually made of cardboard. The marginal walls 4*b*—4*b* and 4*c*—4*c* are preferably formed by reverse bent portions 4*b*-1 and 4*b*-2 (see FIG. 3) of the basic sheet metal from which the pan-shaped frame 4 is made. The frame 4 includes unique chamfered holes 4*d* adjacent each corner of the main vertical wall 4*a*, the holes being formed by deformation of the metal forming this wall rearwardly as by punching or otherwise forcing the metal from the plane of the main vertical wall 4*a*. The rearwardly extending wall projections 4*d*′ which form the holes 4*d* are best shown in FIG. 3. The frame is anchored by mounting screws 6 in a manner to be described.

The frame receives a glare-reducing panel 13 which, together with the poster or sign 11, is held in place within the recess of the frame 4 by top and bottom magnet mounting bars 7—7 and left and right magnet bars 7′—7′. These bars have a unique construction to be described. They are placed against the inner faces of the marginal walls 4*b*—4*b* and 4*c*—4*c* respectively, so as to hold the peripheral portions of the glare-reducing panel 13 and the sign or poster 11 contiguous to the main vertical wall 4*a* of the frame 4. The heads 6*a* of the screws 6 are fully recessed within the chamfered holes 4*d* so that the heads do not bear against the poster or sign 11.

To maintain the frame 4 in a perfectly vertical position and to eliminate any unsightly gaps between the rear face of the frame wall 4*a* and the wall surface 15 upon which the frame 4 is mounted, a spacer board 12 of masonite or other similar material of the same size as the frame 4 is provided. The spacer board has openings 12*a* between the board and the frame. These openings are aligned with chamfered holes 4*d* of the frame 4 to fully receive the rearwardly projecting hole-defining walls 4*d*′, so that the rear surface of the main vertical wall 4*a* of the frame 4 and the front surface of the spacer board 12 are flush against each other. The threaded shanks of the screw 6 may be anchored to the wall surface 15 in any suitable conventional way. It is apparent that the mounting wall surface 15 can be any suitable vertical surface which is prepared for receiving the threaded shanks of the screws 6.

The magnet bars 7—7 and 7′—7′ are constructed to maximize the magnetic efficiency of the magnetic material forming part thereof. They are preferably of a color which blends with the color chosen for the frame 4, so that the bars and the marginal walls 4*b* and 4*c* appear as one wide margin for the frame. The bars 7—7 and 7′—7′ have cores 7*a*—7*a* and 7*a*′—7*a*′ of generally rectangular cross section anchored in channel-shaped members 7*b*—7*b* and 7*b*′—7*b*′. When the bars are positioned in the frame 4, the open ends of the channel-shaped members face outwardly toward the marginal walls 4*b*—4*b* and 4*c*—4*c* of the frame 4 to present an attractive smooth outer surface which, as indicated, matches the color and appearance of these marginal walls.

The frame shown in FIGS. 1–3 has great flexibility for supporting signs, posters, etc. of all sizes equal to or smaller than the full sized poster or sign 11 shown therein. Thus, because the main vertical wall 4*a* is made of a magnet-attracting material, as are the marginal walls 4*b*—4*b* and 4*c*—4*c*, smaller pieces of printed sheet material like 18, 20, and 22 as shown in FIG. 5 (which shows a modified frame 4′ to be described) may be magnetically held to the main wall 4*a* by such means as magnet strips or tabs 21 or a magnet-forming backing layer 21′ placed on the smaller pieces of sheet material. As shown in FIG. 5, in this and most other applications of the invention, the sheets of material involved, like 18, 20, and 22, are preferably overlaid with a glare-reducing panel 13′, in turn, held in place by the magnet bars 7″—7″ and 7‴—7‴ like those shown in FIGS. 1–3.

The most preferred form of the invention, the spacer board 12 is not used. As shown in FIGS. 4 through 8, the modified frame 4′ has on the back thereof peripheral cushion-forming mounting strips 24 which are aligned and extend along the entire length of the margins of the rear vertical wall 4*a*′ of the pan-shaped frame. These cushion-forming mounting strips are much thicker than the extent to which the chamfered hole-forming walls 4d' project from the rear face of the main vertical rear wall 4a' of the mounting frame 4' (see FIG. 7), so that they space the walls 4d' of the chamfered holes from the wall on which the frame is to be mounted. These mounting strips 24 can support the entire frame 4' and its contents on a vertical wall surface by virtue of the adhesive holding properties of the strips 24. To aid in holding the frame on the wall 15, additional strips like 24a may be added to the central portion of the frame wall 4a'. When screws are used to anchor the frame as shown in FIG. 8, the cushion-forming mounting strips 24 are compressed by the tightening of the screws. In all cases, the strips fill in the gaps which otherwise would be present between the mounting wall 15 and the rear wall 4a' of frame wall 4a'.

As best shown in FIG. 7, each strip 24 has a main body portion 24a of polyurethane foam or similar material, an inner adhesive inner layer 24b which adheres the strips 24 to the frame wall 4a', and an outer adhesive layer 24c covered by a replaceable cover layer 24d which is removed to expose the adhesive layer 24c if the frame is to be secured to the wall 15 by the strips 24 rather than by screws.

Refer now to FIGS. 9 and 10 which illustrates a further modified frame 4''. As there shown, the upper portion of the frame is large enough to receive a 22×28" sign or poster or bank information strips, as shown, and a lower portion which folds a removable brochure carrying rack 30. The information strips 26 have a magnetic material backing 26, which magnetically secures each of the strips 26 to the front surface of the main vertical wall 4a'' of the frame 4''. The left and right magnet mounting bars 7''—7'' extend the full height of the front opening of the frame to cover the end margins of the information strips 26 and frame the rack 30. The top magnet mounting bar 7''' covers the upper margin of the uppermost strip 26. A bottom magnet mounting bar 7''' extends along the bottom margin of the frame opening. The bottom margin of the bottommost strip 26 is covered by a removable border-forming bar 28 best shown in FIG. 10. This border-forming bar 28 as illustrated has a main body portion 28a to the rear of which is attached a narrower magnet strip 28b which makes contact with the front surface of the frame vertical rear wall 4a'. The bar 28 thus defines recesses 28a''—28a'' to receive a margin of a strip 26 so that the margins of the strip are attractively covered by the border-forming bar 28.

The bar 28 is shown spaced from the bottom of the frame to leave space for reception of the brochure-carrying rack 30. This rack 30 has an L-shaped magnet-attracting metal frame 31 formed by vertical rear wall 31a and a bottom wall 31b terminating in a lip 31c. A panel is placed in a slot defined between the lip 31c and the front legs 36a of T-shaped partition forming members 36. Each member 36 have a rear flange 36b having a magnet-forming strip 36c on the back thereof to adhere each member at a desirable location to the rack frame rear wall 31a. The space between the frame rear wall 31a and panel 32 is thus divided into spaces into which informational brochures 34 are placed. The rear wall 31a of the rack has a layer of suitable magnetic-forming material which will adhere the rack to the front surface of the vertical rear wall 4a of the frame 4'. The rack 30 preferably just fits into the space of the frame defined between the border-forming bar 28, and the left, right and bottom magnet mounting bars 7''—7'' and 7'''.

It is thus apparent that the mounting frame 4, has extreme flexibility in the manner in which it can be mounted upon a vertical wall surface. If it is preferred to mount the frame 4' without the use of screws, then the removable cover layer 24d of the strips 24 are removed to expose the adhesive layers 24c of these strips. The adhesive is a pressure sensitive one so that by pressing the frame against the vertical wall, the frame will be adhesively secured to the wall. When screws are used to anchor the frame the cover layers 24d are left in place. The screw heads are recessed within the chamfered holes so that printed sheet material involved fits neatly against the vertical back wall 4a' of the frame. The magnet mounting bars and the border-forming bar allow a variety of choices of the use of the frame. The frame has a very neat appearance when mounted on a wall. All gaps between the rear wall of the frame and the mounting wall surface are filled by the cushion-forming mounting strips 24 of the invention shown in FIGS. 4 through 10 or by a spacer board 12 in the form of the invention shown in FIGS. 1 through 3.

The present invention has thus provided an extremely flexible, easy to assemble, securely mounted sign system for both relatively large posters or signs and smaller sheets of printed material.

While the invention has been described with reference to a preferred embodiment, it will be understood by those skilled in the art that various changes may be made and equivalents may be substituted for elements thereof without departing form the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

What is claimed is:

1. A wall mountable frame comprising: a rectangular pan-shaped frame including a main rectangular vertical rear wall having forwardly extending magnet-attracting marginal walls defining a rectangular sign or poster receiving recess, screw head-receiving holes in said main vertical wall for receiving the heads of wall mounting anchoring screws which will be fully recessed in said holes and anchor the frame to a frame mounting wall surface, the defining walls of said holes being formed by rearwardly projection portions of said main vertical wall; magnet bars insertable along the marginal walls of said frame where they are magnetically secured to said forwardly extending marginal walls, to retain the peripheral portion of a poster or sign or a glare-reducing panel inserted into said front recess and placed against said main vertical wall of said frame; and spacing means behind said frame for engaging said mounting wall surface and spacing said projecting portions therefrom; said spacing means being cushion-forming strips secured to the rear surface of said frame vertical rear wall and of a thickness to extend rearwardly behind the rear margin of said projections and to be compressed by the pressure of the screw heads on said frame vertical wall.

2. The wall mountable frame of claim 1 wherein said strips extend along the entire periphery of said vertical frame wall to eliminate gaps between the margin of the frame vertical wall and said frame mounting surface.

3. The wall mountable frame of claims 1 or 2 wherein said cushion-forming strips have an inner layer of adhesive which adheres the strips to the rear surface of the rear wall of the frame and an outer adhesive layer covered by a peelable strip to expose the outer adhesive layer when the outer adhesive layer is to be used to secure the frame to a vertical wall surface.

4. A wall mountable frame comprising: a rectangular pan-shaped frame including a main rectangular vertical rear wall having forwardly extending magnet-attracting marginal walls defining a rectangular sign or poster receiving recess, screw head-receiving holes in said main vertical wall for receiving the heads of wall mounting anchoring screws which will be fully recessed in said holes and anchor the frame to a frame mounting wall surface, the defining walls of said holes being formed by rearwardly projection portions of said main vertical wall; magnet bars insertable along the marginal walls of said frame where they are magnetically secured to said forwardly extending marginal walls, to retain the peripheral portion of a poster or sign or a glare-reducing panel inserted into said front recess and placed against said main vertical wall of said frame; and spacing means behind said frame for engaging said mounting wall surface and spacing said projecting portions therefrom; said spacing means being a spacer board to be placed against a vertical mounting wall and behind said frame to keep said frame in a vertical plane, said spacer board having holes alignable with said rearwardly extending hole-forming projections to fully receive then so that the rear surface of said main vertical wall of said frame can be flush against the front surface of said spacer board.

5. A wall mountable frame pan-shaped frame comprising: a main rectangular vertical rear wall having forwardly extending magnet-attracting marginal walls defining with said main wall a rectangular sign or poster receiving recess, screw head-receiving holes in said main vertical wall for receiving the heads of wall mounting anchoring screws which will be fully recessed in said holes; and magnet bars insertable inside and along the marginal walls of said frame where they are magnetically secured to said marginal walls, to retain the peripheral portion of a poster, sign or a glare-reducing panel inserted into said front recess and placed against said main vertical rear wall of said frame; each of said magnet bars comprising a channel-shaped body of low magnetic reluctance and having a web and spaced flanges, and magnet-forming material filling the space between said flanges.

6. The wall mountable sign system of claims 1 or 4 wherein said rectangular frame is made of sheet metal, the margins of said main rectangular vertical rear wall merging with bent portions of the sheet metal forming said magnet-attracting marginal walls, the color of said magnet bars being similar to the color of said outwardly extending marginal walls so that the width of the margin of the frames appears to be that of the thickness of said marginal walls and the width of said magnet bars.

7. In combination, a wall mountable frame comprising a rectangular frame including a main vertical rectangular rear wall having forwardly extending magnet-attracting marginal walls defining a rectangular recess having an upper portion of a size to receive a sign or poster or other printed sheet material and a rack-receiving lower portion; means for anchoring said frame to a vertical wall mounting surface, top and bottom magnet bars insertable inside and along the top and bottom marginal walls of said frame and left and right magnet bars insertable inside and along the left and right marginal walls of the frame, where the bars are magnetically secured to said marginal walls to retain the peripheral portion of a poster, sign or a glare-reducing panel inserted into said front recess and placed against said main vertical rear wall of said frame; a removable brochure-carrying rack placeable in said lower portion of said frame recess, the rack having a magnet-forming rear surface for magnetically adhering the rack to said main rectangular vertical rear wall of the frame which is also made of a magnet-attracting material; and a border-forming bar insertable in the frame recess so that it extends horizontally along the bottom margin of printed sheet material placed in said upper portion of said recess and to cover over the bottom margin of a lowermost piece of sheet material, said border-forming bar being located above said brochure-forming rack when placed in said lower portion of said recess.

8. The combination of claim 7 wherein said combination includes horizontal strips of information-containing material to said vertical rear wall of the frame one above the other so that the strips are not abutted, said top left and right magnet bars covering the side margins of all of the strips and the top margin of the top strip, said border-forming bar having a recess in the top thereof which receives the bottom margin of the lowermost of said strips, and said rack being adhered to said vertical rear wall of the frame and substantially filling the space between said border-forming bar and the bottom magnet bar.

9. A wall mountable sign or poster holding structure comprising: a pan-shaped sheet metal frame including a main rectangular vertical rear wall having forwardly extending magnet-attracting marginal walls defining with said main wall a rectangular sign or poster receiving recess, and means for securing said frame to a vertical wall; and magnet bars insertable inside, and of a length to extend for substantially the entire extend of, the marginal walls of said frame where they are magnetically secured to said marginal walls, to retain the peripheral portion of a poster, sign or a glare-reducing panel inserted into said front recess against said main vertical rear wall of said frame, said bars when so inserted being visible from the front of said frame, each of said magnet bars comprising a channel-shaped body of low magnetic reluctance and having a web and spaced flanges, and magnet-forming material filling the space between said flanges, the outer end of said flanges when facing said marginal walls exposing said magnet-forming material to said marginal walls to which it is attached.

10. The structure of claim 9 wherein the color of said channel-shaped body is similar to the color of said marginal walls so that said marginal walls and the magnet bars appear on one marginal frame portion for said recess.

* * * * *